US008297250B2

(12) United States Patent
Nieda et al.

(10) Patent No.: US 8,297,250 B2
(45) Date of Patent: Oct. 30, 2012

(54) RECOIL STARTER

(75) Inventors: Seiichi Nieda, Tokyo (JP); Hirotoshi Fujita, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 360 days.

(21) Appl. No.: 12/706,820

(22) Filed: Feb. 17, 2010

(65) Prior Publication Data

US 2010/0206259 A1 Aug. 19, 2010

(30) Foreign Application Priority Data

Feb. 17, 2009 (JP) ..... P2009-033715

(51) Int. Cl.
*F02N 1/00* (2006.01)
*F02N 3/02* (2006.01)

(52) U.S. Cl. ..... 123/185.14; 123/185.3

(58) Field of Classification Search ..... 123/185.14, 123/185.3, 185.5, 185.6, 185.13
See application file for complete search history.

(56) References Cited

U.S. PATENT DOCUMENTS

| | | | | |
|---|---|---|---|---|
| 6,901,899 | B2 * | 6/2005 | Tsunoda et al. | 123/185.14 |
| 7,234,431 | B2 * | 6/2007 | Adam et al. | 123/185.14 |
| 7,650,868 | B2 * | 1/2010 | Fujita et al. | 123/185.14 |
| 2004/0084004 | A1 * | 5/2004 | Tsunoda et al. | 123/185.3 |
| 2004/0123828 | A1 * | 7/2004 | Sing et al. | 123/185.14 |
| 2004/0177823 | A1 | 9/2004 | Saito | |
| 2005/0252477 | A1 * | 11/2005 | Schriever et al. | 123/185.14 |
| 2006/0081209 | A1 * | 4/2006 | Hashiba | 123/185.3 |
| 2008/0173272 | A1 * | 7/2008 | Fujita et al. | 123/185.3 |
| 2010/0162985 | A1 * | 7/2010 | Hashiba et al. | 123/185.3 |

FOREIGN PATENT DOCUMENTS

| | | | |
|---|---|---|---|
| CN | 1526942 | A | 9/2004 |
| CN | 2743569 | Y | 11/2005 |
| CN | 1763363 | A | 4/2006 |
| CN | 101230822 | A | 7/2008 |
| EP | 1 253 315 | | 10/2002 |
| EP | 1 413 746 | | 4/2004 |
| EP | 1 647 706 | | 4/2006 |
| JP | 2008-180144 | | 8/2008 |

OTHER PUBLICATIONS

Chinese Office Action dated Jul. 3, 2012 issued in Chinese Patent Application No. 201010119280.X and English translation, 10 pp.

* cited by examiner

*Primary Examiner* — Thomas Moulis
(74) *Attorney, Agent, or Firm* — Nixon & Vanderhye P.C.

(57) ABSTRACT

A recoil starter includes a case; a reel pivot formed on the case; a rope reel rotatably supported on the reel pivot; a recoil spring; a cam; a power storage spring interposed between the rope reel and the cam; and a power storage ratchet mechanism disposed between facing surfaces of the rope reel and the cam and. The power storage ratchet mechanism is configured to disengage the rope reel and the cam when the rope reel rotates in an engine-starting direction, and engage the rope reel and the cam when the rope reel rotates in an opposite direction to the engine-starting direction.

11 Claims, 5 Drawing Sheets

RECOIL STARTER

CROSS-REFERENCE TO RELATED APPLICATIONS

This application claims priority from Japanese Patent Application No. 2009-033715 filed on Feb. 17, 2009, the entire contents of which are herein incorporated by reference.

BACKGROUND OF THE INVENTION

1. Field of the Invention

An aspect of the present invention relates to a recoil starter in which a rope is pulled to rotate to transmit rotation of the rope reel to a drive pulley connected to an engine crankshaft via a clutch mechanism to thereby start the engine.

2. Background Art

There is known a recoil starter including a rope reel around which a rope is wound and which is rotationally urged by a recoil spring to rewind the rope, a cam to be engaged with a drive pulley coupled to an engine via a centrifugal clutch to thereby transmit the rotation of the rope reel to the drive pulley, and a damper power storage mechanism interposed between the rope reel and the cam. Rotational power of the rope reel is stored in the damper power storage mechanism and then transmitted to the drive pulley via the cam to start the engine, so that impact due to an abrupt change in an engine-side is not transmitted to the rope reel side.

In such recoil starter, the damper power storage mechanism includes a power storage spring which is disposed within a recess portion on a lateral surface of the rope reel. The damper power storage mechanism also includes, as an engaging/disengaging means, a ratchet member mounted on a radial-outer portion of the rope reel and an engaging portion formed on an outer circumferential surface of the cam, the ratchet member and the engaging portion being made to engage with and disengage from each other. When the rope reel rotates in an engine-starting direction to coil up the power storage spring, the ratchet member is not in engagement with the engaging portion. And, when the rope reel rotates in an opposite direction to the engine-starting direction, the ratchet member is brought into engagement with the engaging portion so as to hold a coiled-up condition of the power storage spring, thereby storing power in the power storage spring (for example, refer to JP-2008-180144-A).

In the damper power storage mechanism of such coil starter, the ratchet member is disposed radially-outside the cam. Since the power storage spring of the damper power storage mechanism is accommodated within the recess portion on the lateral surface of the rope reel, when the ratchet member is mounted on of the outer circumferential portion of the rope reel, the accommodation space for the power storage spring is reduced or narrowed accordingly. To avoid the increase in size, for example, only one ratchet member may be provided.

When only one ratchet member is used, the operating power is not uniformly dispersed or applied between the rope reel and the cam, and hence, the operating power may be applied therebetween while being offset in one direction.

Further, since the ratchet member is disposed radially-outside the cam, dirt and dust easily enter into the ratchet member, for example, through a gap between a rotating pivot of the ratchet member and a bearing portion of the cam.

SUMMARY OF THE INVENTION

One of objects of the invention is to provide a recoil starter which has a compact construction, as well as superior functionality and dustproofness and which can realize a reduction in weight and size.

According to an aspect of the present invention, there is provided a recoil starter including: a case that is disposed on a surface of an engine; a reel pivot that is formed on the case; a rope reel that is rotatably supported on the reel pivot and that has a reel portion formed on an outer circumference thereof around which a rope is wound; a recoil spring that rotationally urges the rope reel to rewind the rope; a cam that is engageable with the engine via a clutch so as to transmit a rotational power to the engine; a power storage spring that is interposed between the rope reel and the cam to store a rotational power of the rope reel and that transmits the stored rotational power to the cam to thereby start the engine; and a power storage ratchet mechanism that is disposed between facing surfaces of the rope reel and the cam and that is configured to disengage the rope reel and the cam so that the power storage spring is coiled up when the rope reel rotates in an engine-starting direction, and engage the rope reel and the cam so that the rope reel and the cam rotate together while keeping a coiled-up condition of the power storage spring when the rope reel rotates in an opposite direction to the engine-starting direction.

The power storage ratchet mechanism may include: a cam groove that is formed on a surface of the cam which faces to the rope reel; a ratchet member that is disposed on a surface of the rope reel which faces to the cam and that includes a ratchet pawl engageable with the cam groove; and a friction plate that is disposed between the ratchet member and the cam. And, the friction plate may be configured to retreat the ratchet pawl to disengage the ratchet pawl and the cam groove by being rotated in the engine-starting direction linkedly with the rope reel; and release the ratchet pawl to engage the ratchet pawl and the cam groove by being rotated in the opposite direction linkedly with the rope reel.

The friction plate may include an opening defined therein. The ratchet pawl may be engaged to the cam groove by passing through the opening in the friction plate. And, the ratchet pawl may be disengaged from the cam groove by being retreated along a peripheral edge of the opening.

The opening of the ratchet pawl may be a hole or a notch.

A plurality of cam grooves may be formed on the cam. A plurality of ratchet pawls may be formed on the ratchet member. And, a plurality of openings may be defined in the friction plate.

The cam grooves, the ratchet pawls and the openings may be circumferentially arranged at equal intervals, respectively.

The number of the cam grooves may be twice the number of the ratchet pawls.

The ratchet pawl may be formed to have a triangular sectional shape or a trapezoidal sectional shape.

The ratchet member and the ratchet pawl may form a sectional shape including at least: a flat portion parallel with an axis direction of the reel pivot; a vertical portion perpendicular to the axis direction; and a inclined portion connecting the vertical portion and the flat portion.

The ratchet member may be urged toward the cam by a spring.

The friction plate may be frictionally rotated linkedly with the rope reel via a wave washer.

According to the above configuration, when the rope reel is rotated in the engine-starting direction by pulling out the rope, the engagement between the rope reel and the cam is released by the power storage ratchet mechanism, whereby since only the rope reel rotates, the power storage spring is coiled up. Conversely, when the rope reel rotates in the opposite direction to the engine-starting direction, the rope reel and the cam are brought into engagement with each other and the rope reel and the cam rotate together, whereby since the rope reel and the cam rotate together, power stored in the power storage mechanism is so kept.

When the rope reel is rotated in the engine-starting direction again by pulling out the rope, the power storage spring is coiled up further, whereas when the rope reel rotates reversely, the rope reel and the cam rotate together with the stored power held as it is. Then, in the event that a sufficiently strong spring power is stored in the power storage spring in the way described above, when the rope reel is rotated in the engine-starting direction, the cam rotates by virtue of the spring force stored in the storage spring, whereby the engine starts.

Since the power storage ratchet mechanism is provided between the confronting surfaces of the rope reel and the cam, the power storage ratchet mechanism is made difficult to be affected by dirt and dust at a working site and is hence superior in dustproofness. Further, since the power storage ratchet mechanism can be configured as the compact structure between the facing surfaces, there is required no large installation space for the same mechanism. Consequently, the recoil starter can be reduced in size and weight.

DETAILED DESCRIPTION OF EMBODIMENTS

Figure 1:
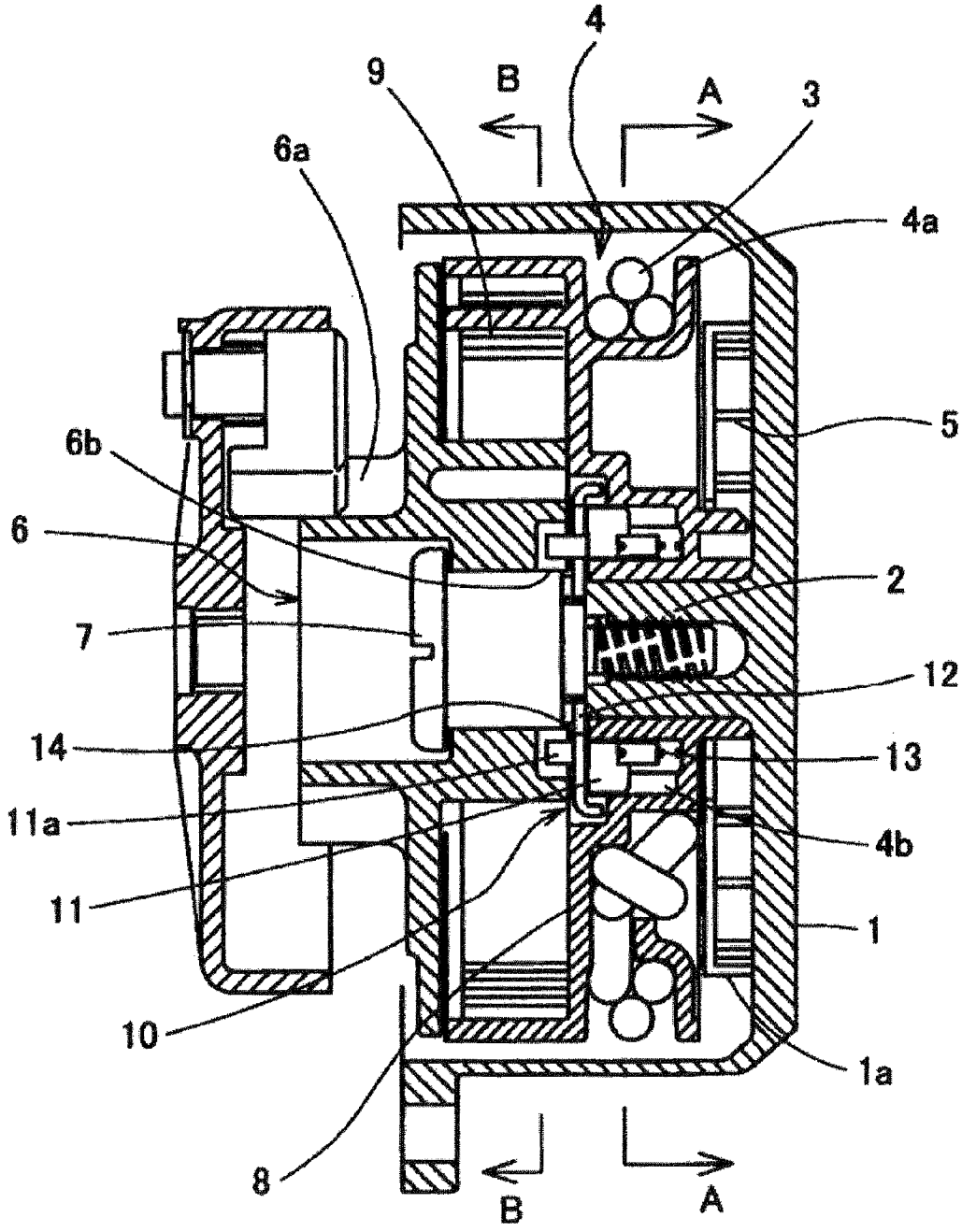
FIG. 1 sectionally illustrates a recoil starter according to an embodiment.
Figure 2:
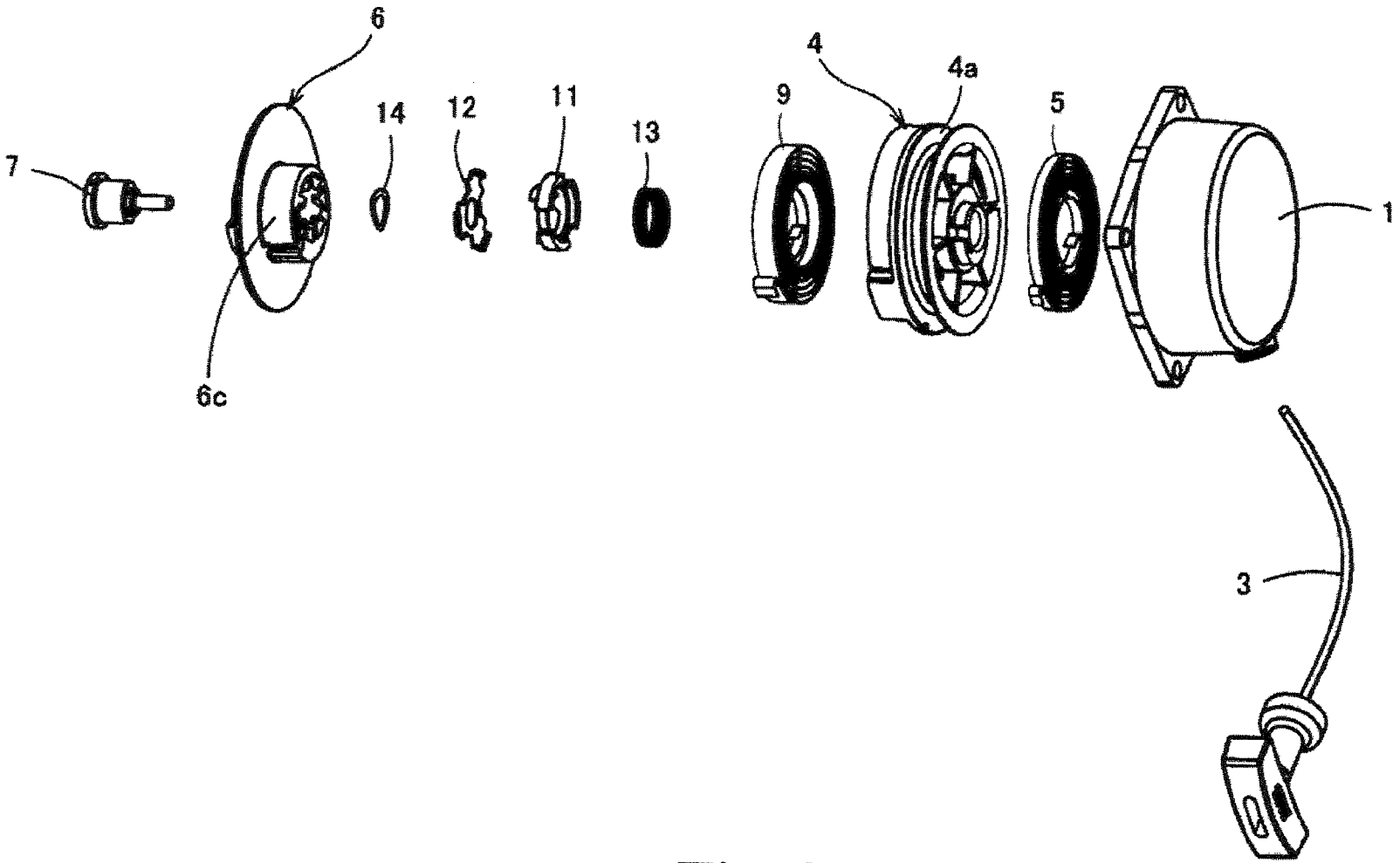
FIG. 2 is an exploded perspective view of the recoil starter.

An embodiment of the invention will be described based on FIGS. 1 to 5B. As is illustrated in the sectional view in FIG. 1 and the exploded perspective view in FIG. 2, a recoil starter according to the embodiment includes a case 1 which is formed to cover a part of an engine (not shown) while accommodating a main part of the recoil starter thereinside. A reel pivot 2 is formed on an inner wall surface of the case 1 so as to confront a crankshaft of the engine. A rope reel 4 and a cam 6 are supported rotatably on the reel pivot 2. A rope 3 is wound around the rope reel 4.

The rope 3 is wound round a reel portion 4*a* formed on an outer circumferential surface of the rope reel 4 so that one end thereof is fixed to the rope reel 4 and the other end thereof is pulled out of the case 1 (not shown). The rope reel 4 is driven to rotate about the reel pivot 2 by pulling the rope 3 at the other end.

As shown in FIG. 1, a recoil spring 5 is disposed between a right-hand surface (in the figure) of the rope reel 4 and the inner wall surface of the case 1 which faces to the right-hand surface. When the rope reel 4 has been rotated in an engine-starting direction by pulling the rope 3 out of the reel portion 4*a*, the recoil spring 5 rotates the rope reel 4 in an opposite direction so as to rewind the rope 3 onto the rope reel 4.

A recoil spring accommodation portion 1*a* is formed integrally on an inner surface of the case 1. An inner-side end portion of the recoil spring 5 is fixed to a portion of the rope reel 4 where the rope reel 4 is supported on the reel pivot 2, while the other outer-side end portion is fixed to an annular inner circumferential surface of the recoil spring accommodation portion 1*a*. When the rope reel 4 is rotated in the engine-starting direction by pulling out the rope 3, a rotational power is stored in the recoil spring 5. And, when the rope 3 is released, the rope reel 4 is rotated in an opposite direction to the engine-starting direction by virtue of the rotational power stored in the recoil spring 5, thereby rewinding the pulled-out rope 3 onto the rope reel 4.

The cam 6 is supported rotatably on the reel pivot 2 at a distal side thereof, and a cam piece 6*a* is formed on an outer circumferential surface of the cam 6 so as to be brought into engagement with a clutch mechanism formed on a drive pulley (not shown) that is mounted on the crankshaft of the engine. The cam 6 is supported rotatably on the reel pivot 2 together with the rope reel 4 by a fixing member 7. For example, the fixing member 7 has a screw to be screwed into an end portion of the reel pivot 2.

For example, a centrifugal clutch mechanism is formed on the drive pulley as the clutch mechanism, and the centrifugal clutch mechanism includes a centrifugal ratchet (not shown) rotationally urged by a spring (not shown) toward the cam piece 6*a* formed on the cam 6. When the cam 6 is rotated in the engine-starting direction, the centrifugal ratchet is brought into engagement with the cam piece 6, thereby rotating the drive pulley in the engine-starting direction.

When the engine starts and the drive pulley is rotated via the crankshaft, the centrifugal ratchet rotates against an urging force of the spring by virtue of centrifugal force and moves away from the cam piece 6*a*, so that a rotation is not transmitted from the engine side to the recoil starter side.

As is shown in FIG. 1, an annular recess portion 8 is formed on a left-hand lateral surface (in the figure) of the reel portion 4*a* of the rope reel 4 to accommodate a power storage spring 9, which constitutes a damper power storage means, therein. Outer-side end of the power storage spring 9 is fixed to an annular inner circumferential surface of the recess portion 8, while inner-side end thereof is fixed to an outside of a cylindrical portion 6*c* of the cam 6.

The rope reel 4 and the cam 6 are connected together via the power storage spring 9 to transmit a rotation from the rope reel 4 to the cam 6 via the power storage spring 9. When the cam 6 is prevented from rotating by a starting resistance of the engine, a relative rotation is generated between the cam 6 and the rope reel 4, and the power storage spring 9 stores the rotational power of the rope reel 4.

A power storage ratchet mechanism 10 is provided between facing surfaces of the rope reel 4 and the cam 6 at radial-inner portions thereof. When the rope reel 4 rotates in the engine-starting direction by the rope 3 being pulled out, the ratchet mechanism 10 disengages the rope reel 4 and the cam 6 so as to cause them to move away from each other. On the other hand, when the rope reel 4 rotates in the opposite direction to rewind the pulled-out rope 3, the ratchet mechanism 10 engages the rope reel 4 and the cam 6 with each other so as to be dynamically integrated, whereby the rope reel 4 and the cam rotate together in the opposite direction of the engine-starting direction.

The ratchet mechanism 10 includes a ratchet member 11 having ratchet pawls 11*a*, cam grooves 6*b* on the cam 6, and a friction plate 12. An annular recess portion 4*b* is formed on the left-hand surface (in the figure) of the rope reel 4, and the ratchet member 11 is disposed in the recess portion 4*b* so that the ratchet member 11 rotates together with the rope reel 4. The cam grooves 6*a* on the cam 6 are disposed to confront the ratchet member 11, and the ratchet member 11 is urged from an inside of the recess portion 4*b* toward the cam grooves 6 by an urging spring 13 at all times so as to engage with and disengage from the cam grooves 6*a*. The friction plate 12 is disposed loosely between the ratchet pawls 11*a* of the ratchet member 11 and the cam grooves 6*b* of the cam 6 so as to regulate engagement/disengagement of the ratchet pawls 11*a* and the cam grooves 6*a*.

In this embodiment, the ratchet member 11 is formed into a ring-like shape having three ratchet pawls 11*a* spaced away from each other at equal intervals in a circumferential direction. For example, the three ratchet pawls 11*a* are made up of serrated projecting pawl portions which each includes a vertical portion, an inclined portion and a flat portion lying between the projecting pawl portions 11*a* (refer to FIGS. 3A, 3B, 5A, 5B).

In this embodiment, the cam grooves 6*b* are formed on the right-hand surface (in the figure) of the cam 6, which confront the ratchet pawls 11*a* of the ratchet member 11, so that the cam grooves 6*b* can engage with and disengage from the ratchet pawls 11*a*. For example, six cam grooves 6*b* disposed at equal intervals in the circumferential direction are formed. And, the cam grooves 6*b* are made up of serrated recess portions each including a vertical portion, an inclined portion and a projecting flat portion lying between the recess portions to be engaged with the projecting ratchet pawls 11*a* of the ratchet member 11 (refer to FIGS. 4, 5A, 5B).

Figure 3A:
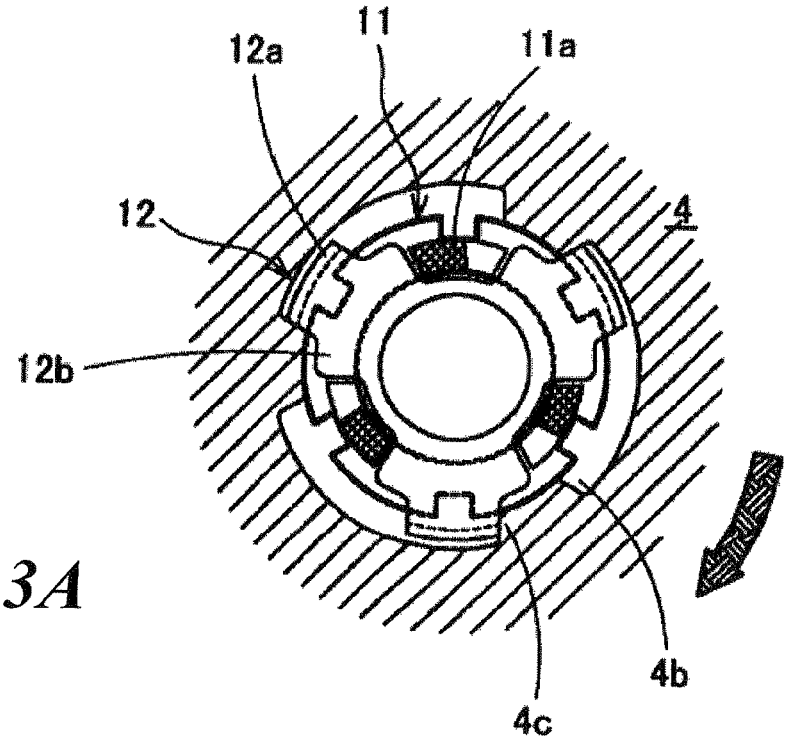
FIGS. 3A and 3B are sectional views taken along the line A-A in FIG. 1, FIG. 3A illustrating a condition where a rope is rewound (stored power is held), FIG. 3B illustrating a condition where the rope is pulled (power is stored).
Figure 3B:
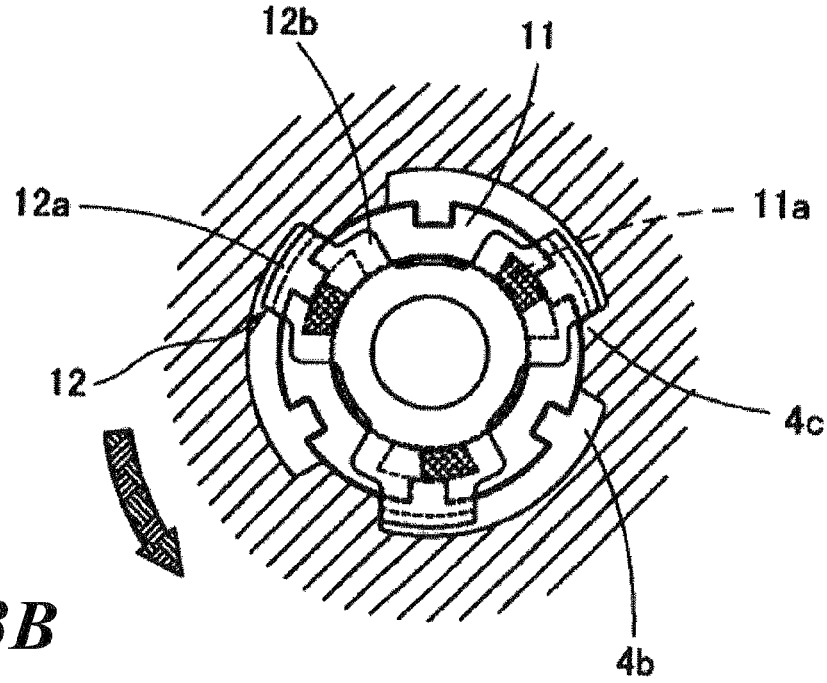
Figure 4:
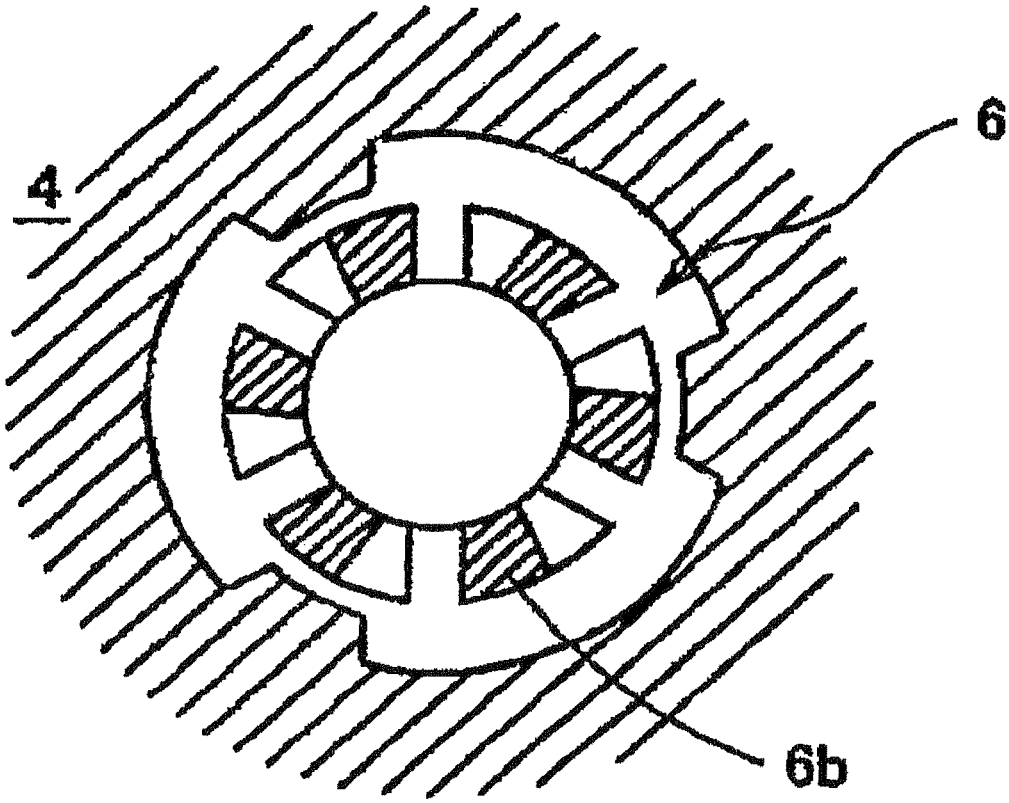
FIG. 4 is a sectional view taken along the line B-B in FIG. 1.

The friction plate 12, which is disposed loosely between the ratchet pawls 11*a* of the ratchet member 11 and the cam grooves 6*b* of the cam 6, is made up of a thin plate-like member and is formed into a ring-like shape having projecting arms 12*a* which project in three directions at equal intervals when viewed from the top thereof as is shown in FIGS. 3A and 3B.

Respective distal end portions of the three arms 12*a* are bent towards the rope reel 4 side (refer to FIG. 1). Projections 4*c* are formed on the annular inner circumferential surface of the annular recess portion 4*b*, and these distal end portions are made to be brought into engagement with the projections 4*c*. In the friction plate 12, three spaces are defined between proximal portions 12*b* of the three arms 12*a*. The ratchet member 11 is urged by the spring 13 so that the projecting ratchet pawls 11*a* thereof pass the three spaces and are brought into engagement with the cam grooves 6*b*.

When the ratchet member 11 is rotated together with the rope reel 4 in the engine-starting direction from a state where the ratchet pawls 11*a* have passed through the spaces between the proximal portions 12*b*, as the ratchet pawls 11*a* overlap the proximal portions 12*b* (as the ratchet pawls 11*a* come beneath the proximal portions 12*b*), the ratchet pawls 11*a* are pushed into the annular recess portion 4*b* of the rope reel 4 against the urging force of the spring 13 by being pressed with lateral surfaces of the proximal portions 12*b*, thereby releasing the engagement between the ratchet pawls 11*a* and the cam grooves 6*a*.

For example, a wave washer 14 is interposed between a lateral surface of the friction plate 12 which confronts the cam grooves 6*b* and a stepped portion of the fixing member 7. When a pressing force is applied to the friction plate 12 towards the cam grooves 6*b* side, the friction plate 12 is pressed against the cam grooves 6*b* via the wave washer 14, whereby the friction plate 12 is brought into friction contact with distal end faces of the cam grooves 6*b*, so as to suppress the rotation thereof.

Next, an operation of the recoil starter will be described. In a state where the engine is not started and the rope 3 of the rope reel 4 is not pulled out, the rope reel 4 is returned to its initial position by the recoil spring 5, and the rope 3 is rewound onto the rope reel 4. The ratchet member 11 of the power storage ratchet mechanism 10 is pushed out of the annular recess portion 4*b* of the rope reel 4 by virtue of the urging force of the spring 13, and the three projecting ratchet pawls 11*a* have passed through the spaces between the proximal portions 12*b* of the three arms 12*a* of the friction plate 12 to thereby be engaged with the corresponding cam grooves 6*b*.

Figure 5A:
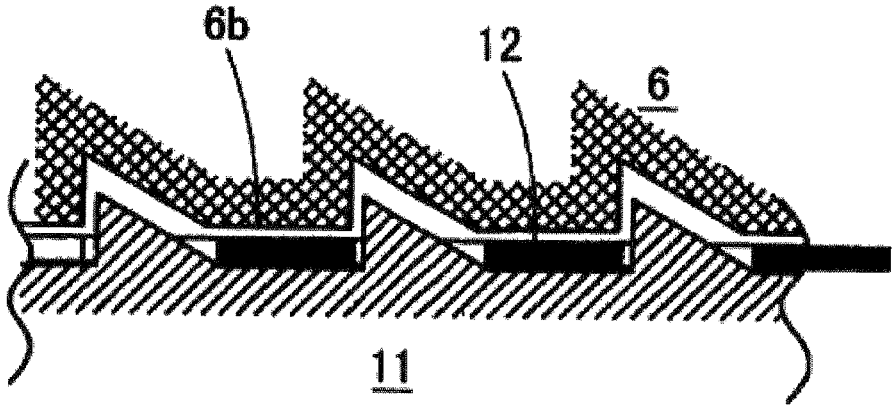
FIGS. 5A and 5B illustrate operating conditions of a power storage ratchet mechanism (damper power storage mechanism) according to the embodiment, FIG. 5A illustrating a condition where the rope is rewound (stored power is held), FIG. 5B illustrating a condition where the rope is pulled (power is stored).
Figure 5B:
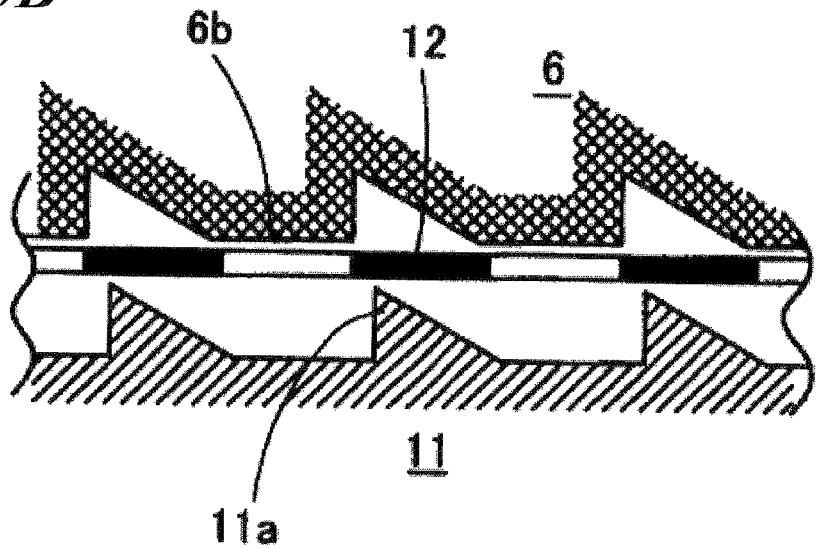

Namely, as shown in FIGS. 3A, 5A, in the power storage ratchet mechanism 10, the ratchet pawls 11*a* pass through the spaces between the proximal portions 12*b*, and the friction plate 12 is held between the ratchet pawls 11*a* and the cam grooves 6*b* so that the pawls 11*a* are engaged with the cam grooves 6*b*, whereby the rope reel 4 and the cam 6 are brought into engagement with each other via the power storage ratchet mechanism 10 and are integrated with each other.

When the rope 3 is pulled out to start the engine from a state where the rope reel 4 is in the initial position shown in FIG. 3A, the rope reel 4 rotates in a counterclockwise direction as shown in FIG. 3B, and the recoil spring 5 and the power storage spring 9 are coiled up.

The ratchet member 11 rotates together with the rope reel 4, the ratchet pawls 11*a* are brought into abutment with the proximal portions 12*b* of the arms 12*a* of the friction plate 12, and the inclined portions of the ratchet pawls 11*a* slide along lateral surfaces of the proximal portions 12*b*. As a result, the ratchet member 11 is pushed into the annular recess portion 4*b* of the rope reel 4 against the urging force of the spring 13, and the ratchet pawls 11*a* of the ratchet member 11 are covered by the lateral surfaces of the proximal portions 12*b* of the friction plate 12 so that the ratchet member 11 is kept forcibly confined within the annular recess portion 4*b* and so that the ratchet pawls 11*a* thereof are prevented from projecting (refer to FIG. 3B).

Almost at the same time, the projections 4*c* on the annular inner circumferential surface of the annular recess portion 4*b* are brought into abutment with the distal end portions of the arms 12*a* of the friction plate 12, whereby the friction plate 12 is caused to rotate together with the rope reel 4 and the ratchet member 11. As this occurs, since the ratchet pawls 11*a* of the ratchet member 11 are covered by the proximal portion 12*b* of the friction plate 12, the ratchet pawls 11*a* are prevented from being brought into engagement with the cam grooves 6*b*. Consequently, the recoil spring 5 and the power storage spring 9 are coiled up in such a state that the ratchet pawls 11*a* of the ratchet member 11 and the cam grooves 6*b* are not allowed to be brought into engagement with each other.

Namely, when the rope 3 is pulled out to start the engine, the rope reel 4 is rotated in a state where the engagement of the pawls is not caused in the power storage ratchet mechanism 10. In other words, the rope reel 4 rotates in a state where the rope reel 4 and the cam 6 are spaced away from each other while surely preventing the ratchet pawls 11*a* of the ratchet member 11 from being brought into engagement with the cam grooves 6*b* of the cam 6 (refer to FIGS. 3B, 5B).

The engine has a staring resistance, and a rotational load by the starting resistance is applied to the cam 6. As long as a rotational drive force by the coiled-up power storage spring 9 is not higher than the rotational load applied to the cam 6, the cam 6 cannot be rotated via the power storage spring 9.

When the rope 3 is released and rewound from the pulled out condition shown in FIG. 3B, the rope reel 4 is rotated quickly by the rewinding force of the recoil spring 5 in a rope-rewinding direction (clockwise direction in FIG. 3A as indicated by an arrow) that is an opposite direction to the engine-starting direction (counterclockwise direction in FIG. 3B as indicated by an arrow). Thus, the rope reel is returned to its initial position while rewinding the rope 3.

As this occurs, the ratchet member 11 rotates together with the rope reel 4 in the rope-rewinding direction. Since the ratchet member 11 is urged by the spring 13 and since the friction plate 12 is prevented from rotating by the wave washer 14, the ratchet pawls 11*a* slide on the lateral surfaces of the proximal portions 12*b* of the friction plate 12 to be pressed towards the cam grooves 6*b*.

Then, the ratchet pawls 11*a* are slid along the lateral surfaces of the proximal portions 12*b* of the friction plate 12 into the spaces opened between the proximal portions 12*b*. The ratchet pawls 11*a* are pushed towards the cam grooves 6*b* by the urging force of the spring 13, and pass through the spaces so as to be brought into engagement with the cam grooves 6*b*, thereby returning into the condition shown in FIGS. 3A, 5A.

The rope reel 4 rotates in the rope-rewinding direction (clockwise direction in FIG. 3A), while keeping the condition as shown in FIG. 3A. This rotation is transmitted to the cam 6 through the engagement of the ratchet pawls 11*a* and the cam grooves 6*b* to thereby rotate the cam 6 integrally together with the rope reel 4 and the friction plate 12 in the opposite direction to the engine-starting direction.

The rope reel 4 is returned to its initial condition shown in FIG. 3A by the aforesaid rotation while the power storage spring 9 is held in the coiled-up condition. Shortly after that, the rope 3 is pulled out again to start the engine.

When the power stored in the power storage spring 9 by the pulling out of the rope 3 exceeds the rotational load by the starting resistance of the engine, the rotational power by the pulling out of the rope 3 and the rotational power stored in the power storage spring 9 are released, the crankshaft is then rotated through the rotation of the cam 6 and engagement of the clutch mechanism whereby the engine is started.

According to the recoil starter of the embodiment, since the power storage ratchet mechanism is provided between the facing surfaces of the rope reel and the cam, the power storage ratchet mechanism can be made compact in size and has superior dustproofness. In addition, since the engaging pawls of the ratchet mechanism are configured as the plurality of uniformly-arranged pawls, the engagement force is dispersed uniformly, and the eccentricity of power is avoided.

The invention is not limited to the aforementioned embodiment but can be changed variously without departing from the spirit of the invention.

For example, the ratchet pawl and the cam groove may have a triangular sectional shape or a trapezoidal sectional shape. The any numbers of the ratchet pawl and the cam grooves are formed. A hole or a notch may be formed in the friction plate as an opening for allowing the ratchet pawl to pass therethrough. Contrary to the exemplified structure, the groove may be formed in the ratchet member, and the pawl may be formed on the cam. Although the direction of rotation is exemplified in the above descriptions, the recoil starter may be configured to reversely rotate.

What is claimed is:

1. A recoil starter comprising:

a case that is disposed on a surface of an engine;

a reel pivot that is formed on the case;

a rope reel that is rotatably supported on the reel pivot and that has a reel portion formed on an outer circumference thereof around which a rope is wound;

a recoil spring that rotationally urges the rope reel to rewind the rope;

a cam that is engageable with the engine via a clutch so as to transmit a rotational power to the engine;

a power storage spring that is interposed between the rope reel and the cam to store a rotational power of the rope reel and that transmits the stored rotational power to the cam to thereby start the engine; and a power storage ratchet mechanism that is disposed between facing surfaces of the rope reel and the cam and that is configured to axially disengage the rope reel and the cam so that the power storage spring is coiled up when the rope reel rotates in an engine-starting direction, and axially engage the rope reel and the cam so that the rope reel and the cam rotate together while keeping a coiled-up condition of the power storage spring when the rope reel rotates in an opposite direction to the engine-starting direction.

2. The recoil starter of claim 1, wherein the power storage ratchet mechanism includes:

a cam groove that is formed on a surface of the cam which faces to the rope reel;

a ratchet member that is disposed on a surface of the rope reel which faces to the cam and that includes a ratchet pawl engageable with the cam groove; and a friction plate that is disposed between the ratchet member and the cam, and wherein the friction plate is configured to retreat the ratchet pawl to disengage the ratchet pawl and the cam groove by being rotated in the engine-starting direction linkedly with the rope reel; and release the ratchet pawl to engage the ratchet pawl and the cam groove by being rotated in the opposite direction linkedly with the rope reel.

3. The recoil starter of claim 2, wherein the friction plate includes an opening defined therein, wherein the ratchet pawl is engaged to the cam groove by passing through the opening in the friction plate, and wherein the ratchet pawl is disengaged from the cam groove by being retreated along a peripheral edge of the opening.

4. The recoil starter of claim 3, wherein the opening of the ratchet pawl is a hole or a notch.

5. The recoil starter of claim 3, wherein a plurality of cam grooves are formed on the cam, wherein a plurality of ratchet pawls are formed on the ratchet member, and wherein a plurality of openings are defined in the friction plate.

6. The recoil starter of claim 5, wherein the cam grooves, the ratchet pawls and the openings are circumferentially arranged at equal intervals, respectively.

7. The recoil starter of claim 5, wherein the number of the cam grooves is twice the number of the ratchet pawls.

8. The recoil starter of claim 2, wherein the ratchet pawl is formed to have a triangular sectional shape or a trapezoidal sectional shape.

9. The recoil starter of claim 2, wherein the ratchet member and the ratchet pawl form a sectional shape including at least:

a flat portion parallel with an axis direction of the reel pivot;

a vertical portion perpendicular to the axis direction; and a inclined portion connecting the vertical portion and the flat portion.

10. The recoil starter of claim 2, wherein the ratchet member is urged toward the cam by a spring.

11. The recoil starter of claim 2, wherein the friction plate is frictionally rotated linkedly with the rope reel via a wave washer.

* * * * *